United States Patent [19]

Roth

[11] Patent Number: 5,029,725

[45] Date of Patent: Jul. 9, 1991

[54] MOLDED PLASTIC MATERIAL CONTAINER

[75] Inventor: Donald J. Roth, Westport, Conn.

[73] Assignee: Continental Can Company, Inc., Norwalk, Conn.

[21] Appl. No.: 77

[22] Filed: Jan. 2, 1987

[51] Int. Cl.[5] ..... B65D 39/00

[52] U.S. Cl. ..... 220/655; 206/508; 206/519; 220/657; 220/658

[58] Field of Search ..... 220/74, 83, 256, 258, 220/355, 655, 657, 658; 206/505, 508, 518, 519, 557, 508, 519

[56] References Cited

U.S. PATENT DOCUMENTS

| | | | |
|---|---|---|---|
| 3,358,879 | 12/1967 | Mueller | 206/519 |
| 3,447,714 | 6/1969 | Elliot | 206/508 X |
| 3,539,552 | 11/1970 | Mounts et al. | 206/519 |
| 3,749,276 | 7/1973 | Davis | 206/519 X |
| 4,358,025 | 11/1982 | Urion | 220/258 |
| 4,373,642 | 2/1983 | Wolters et al. | 206/519 X |

*Primary Examiner*—Steven M. Pollard

*Attorney, Agent, or Firm*—Charles E. Brown

[57] ABSTRACT

A flange assembly of a molded plastic container which is multi-sided. Each side terminates at its upper edge in the flange assembly and the flange assembly includes an inner support flange to which a closure may be bonded. Outwardly of the support flange is an upstanding shock absorbing bead which additionally functions to center the closure on the container. The bead includes an inner leg which is integrally connected to the support flange and an outer leg with the inner leg being joined to the outer leg by a deformable bight portion. When dropped on the side, the package formed of the closed container will have the shock of the impact of striking a surface, such as a floor, absorbed by the deformation of the bead.

1 Claim, 1 Drawing Sheet

MOLDED PLASTIC MATERIAL CONTAINER

This invention relates in general to new and useful improvements in containers, and more particularly to a molded plastic material container which is to receive a closure in sealed relation.

In accordance with this invention, there has been developed a molded plastic material container in the form of a box or the like, which container is of a multi-sided construction and each side thereof terminates in an upper flange assembly which includes an inner support flange for receiving in sealed relation a closure. The container may contain a flowable product which may include liquids.

Like other containers, the container is subject to being dropped at which time the product will rush to the lowermost part of the container and have a tendency to attempt to separate the closure from the container. This tendency of the closure to separate from the container is increased if the support flange is permitted to deform.

In accordance with this invention the flange assembly also includes an outer upstanding bead with the bead forming both means for centering the closure on the support flange and shock absorbing means.

Most particularly, the bead extends upwardly from the support flange to an inverted bight portion and then terminates in an outer leg. The outer leg, in turn, may terminate in a peripheral flange. When dropped, the outer leg resiliently moves towards the support flange by a bending of the bight portion, thereby leaving the support flange substantially shock free.

If desired, each side of the container may also be reinforced by an inwardly directed stiffening flange disposed below the support flange.

With the above and other objects in view that will hereinafter appear, the nature of the invention will be more clearly understood by reference to the following detailed description, the appended claims, and the several views illustrated in the accompanying drawing.

Figure 1:
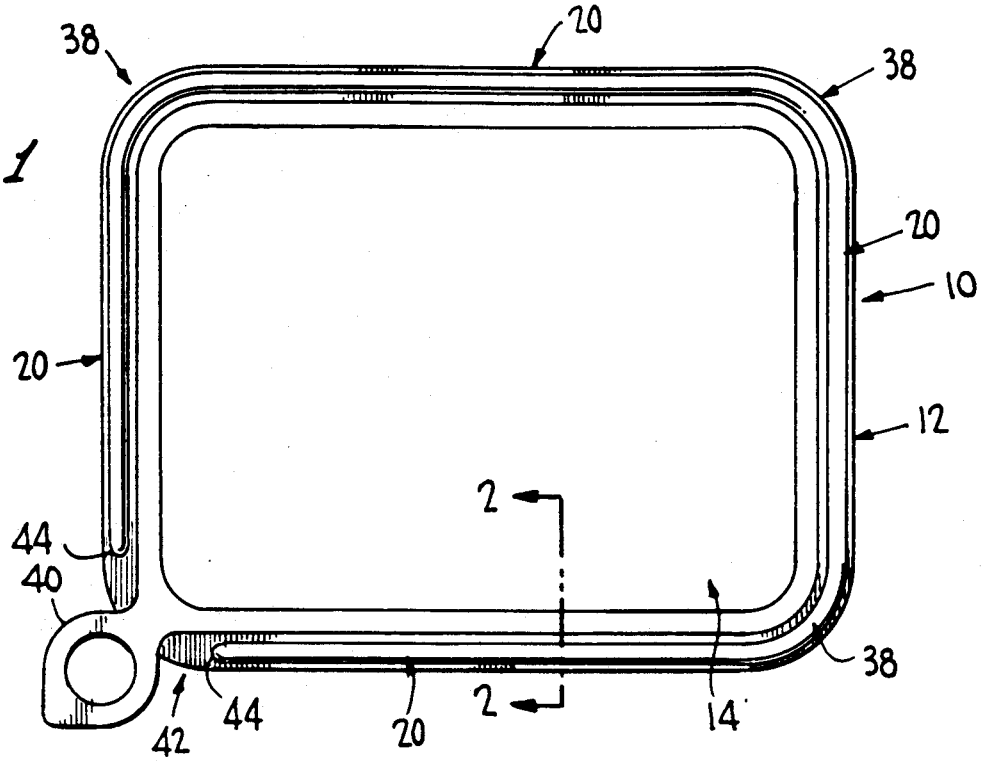
FIG. 1 is a pl an view of a container formed in accordance with this invention and closed by means of a closure.
Figure 2:
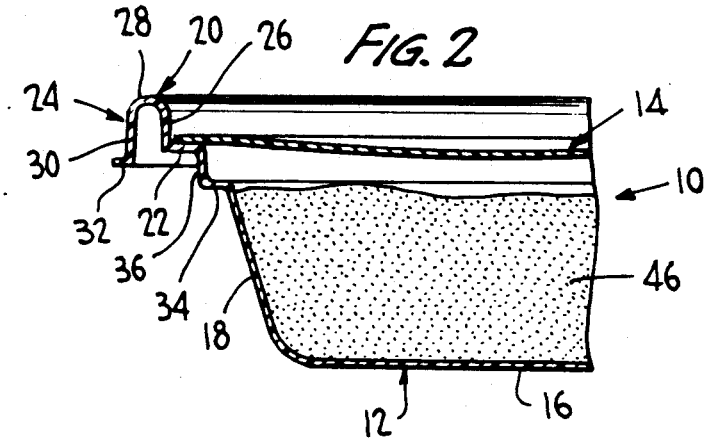
FIG. 2 is an enlarged fragmentary vertical section view taken generally along the line 2—2 of FIG. 1 and shows generally the cross section of the container and the relationship of the closure thereto.

Referring now to the drawings in detail, it will be seen that there is illustrated in FIG. 1 a package generally identified by the numeral 10 and including a container, which is the subject of the invention and identified by the numeral 12, and a closure generally identified by the numeral 14. The container 12 is formed with a plurality of sides and the illustrated container is rectangular in outline. The container 12 includes a bottom wall 16 and a plurality of side walls 18. As is best illustrated in FIG. 2, each side wall 18 terminates at its upper end in a flange assembly generally identified by the numeral 20. Each flange assembly 20 includes a support flange 22 on which the peripheral edge of the closure 14 is seated and to which the closure 14 is heat bonded in a manner which is not the subject of this invention.

The flange assembly 20 includes an upstanding bead generally identified by the numeral 24. The bead 24 includes an inner upstanding leg 26 which is integrally connected to the outer edge of the support flange 22. The inner leg 26 terminates in an inverted bight portion 28 which in turn terminates in a depending outer leg 30. If desired, the outer leg 30 carries a terminal peripheral flange 32 which is outwardly directed Further, it will be seen that the outer leg 30 is longer than the inner leg 26 so that the outer leg 30 extends down below the support flange 22.

In addition, the upper part of each side 18 may be of a stepped configuration so as to include an inwardly directed stiffening flange 34 which is connected to the inner edge of the support flange 22 by an upstanding portion 36.

Returning once again to FIG. 1, it will be seen that the sides 18 are joined together by corners which are rounded. Accordingly, there are corner flange assemblies 38 which are rounded and which join together the flange assemblies 20 of the sides. However, there are only three of the corner flange assemblies 38 in that the closure 14 includes a radially projecting pull tab 40 which is utilized to rupture the bond between the closure 14 and the support flange 22 in the opening of the package 10. Therefore, there is a modified corner flange assembly 42 at the fourth corner of the container 12. The corner flange assembly 42 differs from the corner flange assemblies 38 in that it is free of the bead 24 with the bead 24 terminating at 44 adjacent the corner flange assembly 42.

At this time it is pointed out that the bead 24 serves to align the closure 14 with the container 12 in the manner best shown in FIG. 2. While there is a slight clearance between the periphery of the closure 14 and the inner leg 26 of the bead 24, the clearance is one which is to facilitate automatic alignment.

Figure 3:
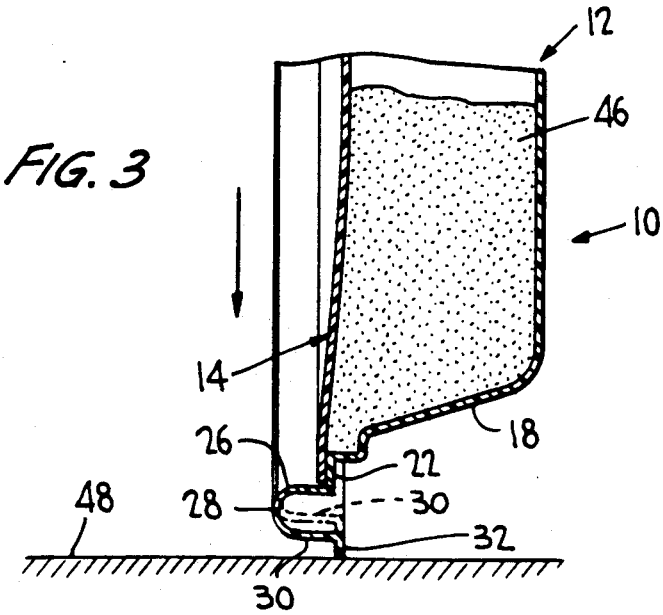
FIG. 3 is a vertical sectional view similar to FIG. 2 but with the container rotated and the flange assembly thereof at one side striking a surface, for example, a floor.

The bead 24 also functions as shock absorbing means as is best shown in FIG. 3.

At this time it is pointed o t that the package 10 includes a product 46 which may be a flowable product so that when the package 10 is dropped, the product 46 will flow towards the lowermost one of the sides 18 and attempt to rupture the bond between the closure 14 and the support flange 22. If the support flange 22 is subjected to an undue shock, this in combination with the pressure exerted by the product 46 would result in the rupture of the bond between the closure 14 and the support flange 22. However, it will be seen that when the peripheral flange 22 strikes a surface, such as a floor 48, the bight portion 28 will deform permitting the outer leg 30 to deflect upwardly towards the inner leg 26, as is shown by dotted lines. Since the shock is absorbed in the bight portion 28, little or no shock is transmitted to the support flange 22.

At this time it is pointed out that although the container 12 and the closure 14 have both been illustrated as being of a single thickness, in practice, both the container 12 and the closure 14 will be formed of a laminated web including a barrier layer. Further, the barrier layer of the closure 14 may be in the form of an aluminum foil layer which may be inductively heated so as to heat seal the closure 14 to the container 12.

Although only a preferred embodiment of the container has been specifically illustrated and described herein, it is to be understood that minor variations may be made in the container construction without departing from the spirit and scope of the invention as defined by the appended claims.

What is claimed as new is:

1. A molded plastic material container, said container being formed of sheet material and being of a multi-sided construction with each side terminating in an upper flange assembly, said flange assembly including an inner support flange for receiving a closure and an outer upstanding bead forming an upstanding continuation of said support flange, said bead forming both means for centering a closure on said support flange and shock absorbing means for the container when the container is dropped, said container having corners joining together said sides, and said upper flange assembly extending around said corners, said bead being interrupted at one of said corners to define a space across said flange assembly for a closure pull tab.

* * * * *